US006171216B1

(12) United States Patent
Wang et al.

(10) Patent No.: US 6,171,216 B1
(45) Date of Patent: Jan. 9, 2001

(54) ANGLE-ADJUSTING DEVICE FOR TREADMILL SUPPORTING FRAME

(76) Inventors: Leao Wang; Peter Wu, both of No 1, Lane 154, Charng Long Rd., Taiping City, Taichung Hsien (TW)

( * ) Notice: Under 35 U.S.C. 154(b), the term of this patent shall be extended for 0 days.

(21) Appl. No.: 09/374,307

(22) Filed: Aug. 16, 1999

(51) Int. Cl.[7] ..... A63B 22/00
(52) U.S. Cl. ..... 482/54; 482/51
(58) Field of Search ..... 482/51, 54

(56) References Cited

U.S. PATENT DOCUMENTS 5,672,140 * 9/1997 Watterson et al. ..... 482/54
5,897,460 * 4/1999 Mcbride et al. ..... 482/54

* cited by examiner

*Primary Examiner*—Glenn E. Richman

(57) ABSTRACT

An angle-adjusting device for a treadmill having a front supporting lever, a handgrip frame, a frame and a running belt. A locating plate is disposed on a bottom of a rear portion of the frame. A polygonal ground-contacting member is pivotally attached to the locating plates. Distances between the pivot attachment and the ground-contacting sides of the ground-contacting member are different. The sloping angle of the frame is dependent on the distance between the attachment pivot and a ground-contacting side and may be varied by pivoting the ground-contacting member.

5 Claims, 4 Drawing Sheets

ANGLE-ADJUSTING DEVICE FOR TREADMILL SUPPORTING FRAME

BACKGROUND OF THE INVENTION

1. Field of the Invention

The present invention relates to an angle-adjusting device for a treadmill supporting frame, and more particularly, to a compact, low-cost and easy-to-use device.

2. Description of the Prior Art

The prior art of U.S. Pat. No. 5,607,375, as shown in FIG. 6, is the most well known angle-adjusting device for a treadmill supporting frame. This prior art includes an engaging member 11 fastened on the rear supporting rod 10, a plurality of stage type engaging bevel teeth 12 at the other end of the engaging member 11, a pivot 13 by which the pivoted plate 15 at the bottom of the frame 14 is pivoted, a supporting member 17 pivoted by a pivot 16 under the pivoted plate 15 and a spring 20 hooked between an axle pin 18 disposed at the bottom end of the supporting member 17 and an opposed axle pin 19 of the pivoted plate 15. At this time, any engaging bevel tooth 12 of the engaging member 11 is supported by the top portion 171 at the other end of the support member 17 and kept in position. Accordingly, in adjusting the sloping angle of the frame 14, it's only required to raise the frame 14 to allow the rear supporting rod 10 to fall down automatically due to its weight by means of the pivot 13. At this point, the engaging bevel tooth 12 at the other end of the engaging member 11 will be shift upwards to permit the next engaging bevel tooth 12 to be supported at the top portion 171 of the supporting member 17. Therefore, the supporting angle of the rear supporting rod 10 is changed so that the sloping angle of the frame 14 is also changed.

Though this conventional product is easy to use, its structure is complex and has too many components. Thus, the production cost is relatively high and it can't meet the economical and efficient requirement of the industry.

SUMMARY OF THE INVENTION

It is a main object of the present invention to provide an angle-adjusting device for treadmill supporting frame that is compact, low-cost, easy-to-assembly and easy-to-use.

BRIEF DESCRIPTION OF THE DRAWINGS

The drawings illustrate two embodiments of the present invention which serve to exemplify the various advantages and objects hereof, and are as follows.

DETAILED DESCRIPTION OF THE PREFERRED EMBODIMENT

Figure 1:
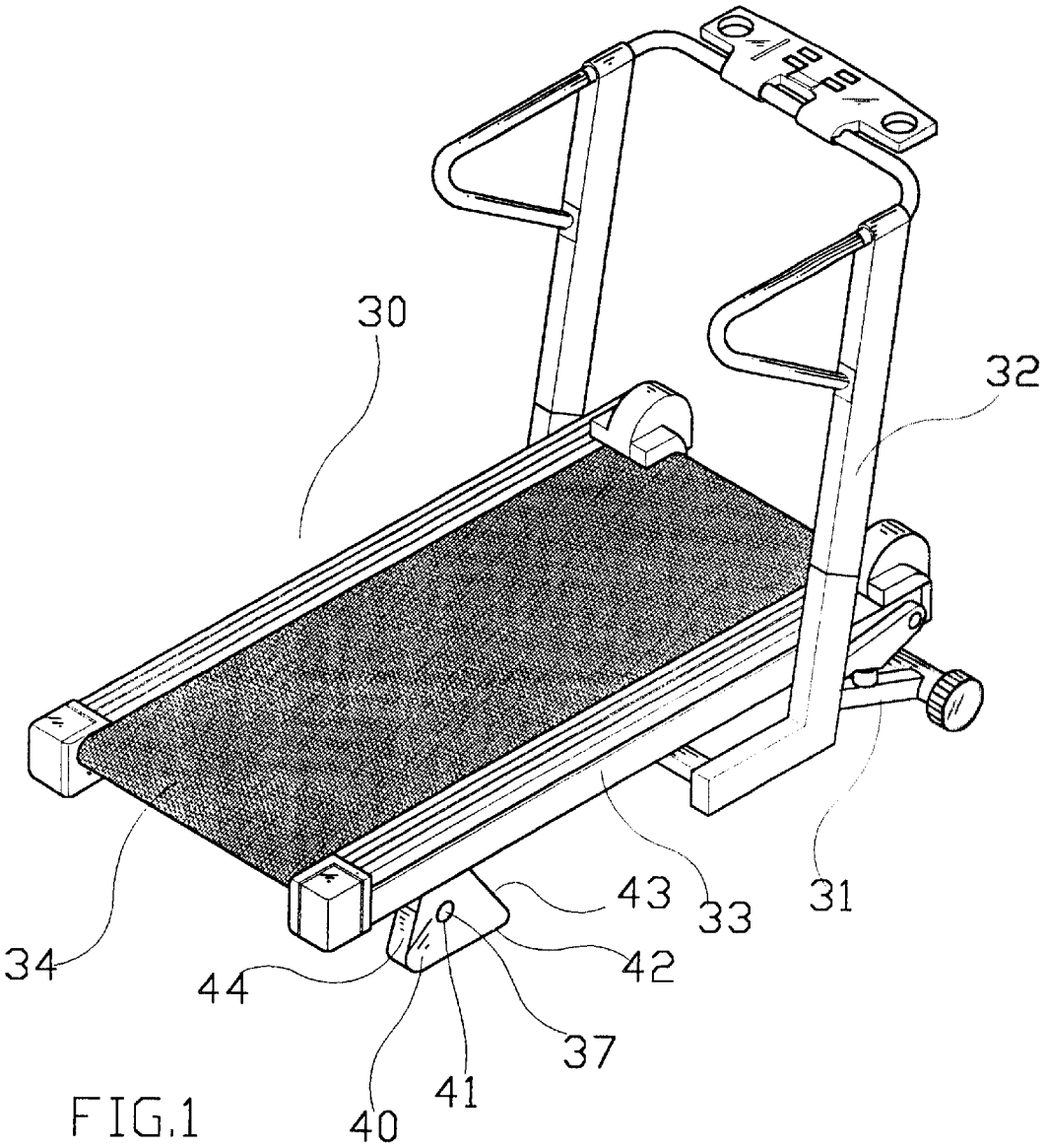
FIG. 1 is a perspective view of a preferred embodiment of the present invention.
Figure 2:
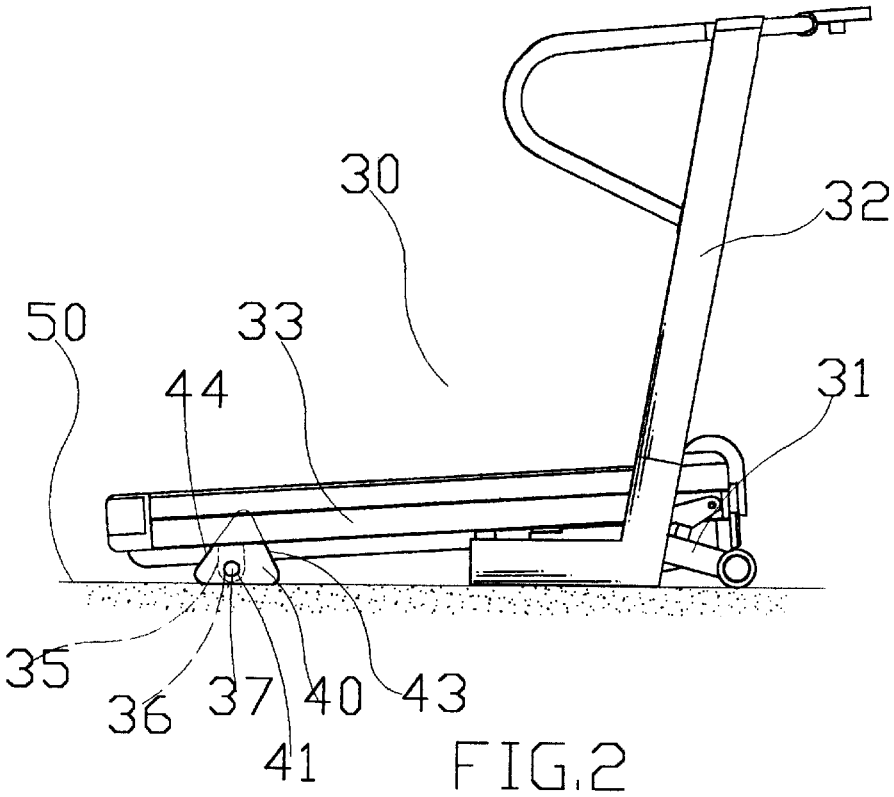
FIG. 2 is a side view in accordance with FIG. 1.

First of all, referring to FIGS. 1 and 2, the angle-adjusting device for a treadmill supporting frame in accordance with the present invention is fitted to the bottom of the rear side of the conventional treadmill frame. The treadmill 30 includes a front supporting lever 31, a handgrip frame 32, a frame 33 and a running belt 34, wherein a locating plate 35 is respectively disposed at certain position at two sides of a bottom of the rear portion of the frame 33 having a pivoting hole 36. A polygonal ground-contacting member 40 is pivoted in the pivoting hole 36 by means of a pivot 37 while the ground-contacting member 40 has a locating borehole 41 at a certain position for connecting it to the pivoting hole 36 of the locating plate 35. The distances of the pin hole 41 to each ground-contacting adjacent sides 42, 43, 44 of the ground-contacting member 40 are different so that, when any adjacent side 42, 43, or 44 of the ground-contacting member 40 contacts the ground 50, the sloping angle of the frame 33 is dependent on the distance of the pin hole 41 (also the position of the pivot 37) to the ground-contacting adjacent sides 42, 43, 44.

Figure 3:
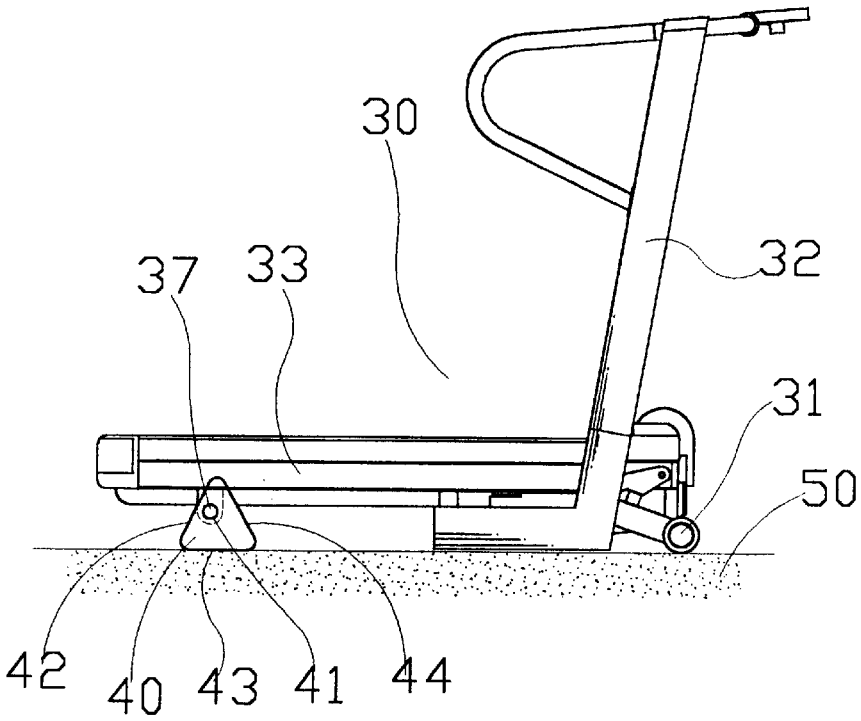
FIG. 3 is a side view in accordance with FIGS. 1 and 2, illustrating the adjustment of the sloping angle by changing the ground-contacting member.

Furthermore, referring to FIG. 3, in changing the sloping angle of the frame 33, it's only required to raise the frame 33 to allow the ground-contacting adjacent sides 42 (43 or 44) of the ground-contacting member 40 to separate from the ground 50. Thereafter, the two ground-contacting members 40 are turned around the pivots 37 to permit the ground-contacting adjacent sides 43 (44 or 42) to be parallel to the ground 50 so that the frame 33 can be in contact with the ground 50. Since the distance of the pivot 37 to the ground-contacting adjacent sides 43 (44 or 42) is changed, the sloping angle of the frame 33 can be easily changed to meet different requirements.

Figure 4:
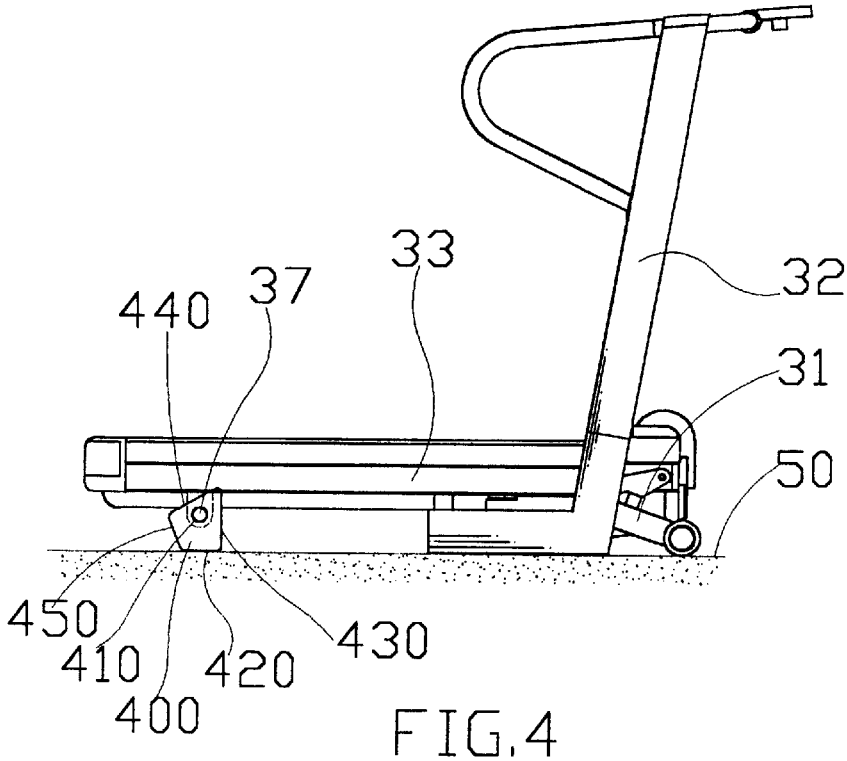
FIG. 4 is a perspective view of another preferred embodiment of the present invention.

FIG. 4 shows another preferred embodiment of the ground-contacting member 40. At least four ground-contacting adjacent sides 420, 430, 440, 450 can be obtained by means of the ground-contacting member 400. Moreover, the distances of the locating borehole 410 to the ground-contacting adjacent sides 420, 430, 440, 450 are different. The more ground-contacting adjacent sides 420, 430, 440, 450 of the ground-contacting member 40 there are, the more the variation of the supporting angle of the frame 33.

Figure 5:
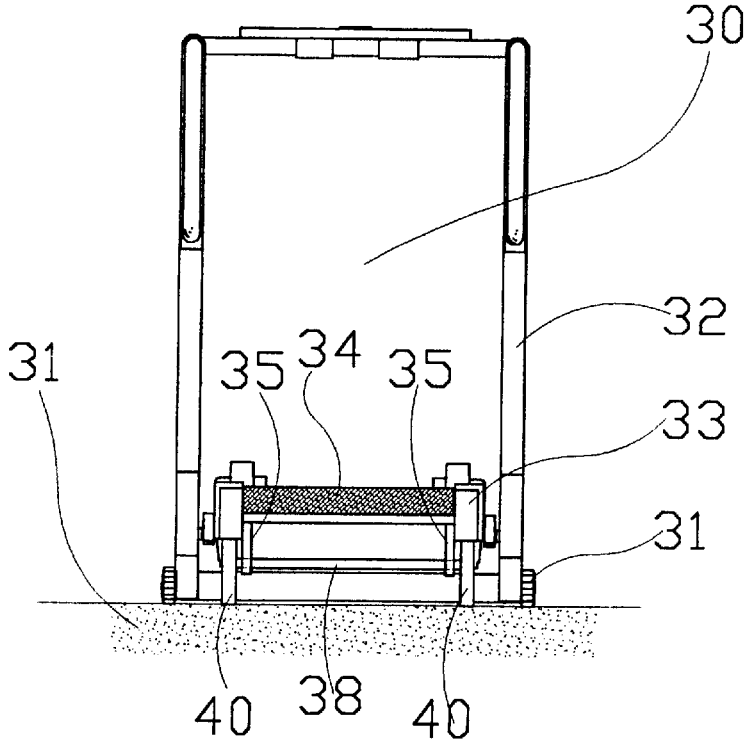
FIG. 5 is a schematic drawing of the present invention, illustrating that the ground-contacting members at two sides are axially mounted.
Figure 6:
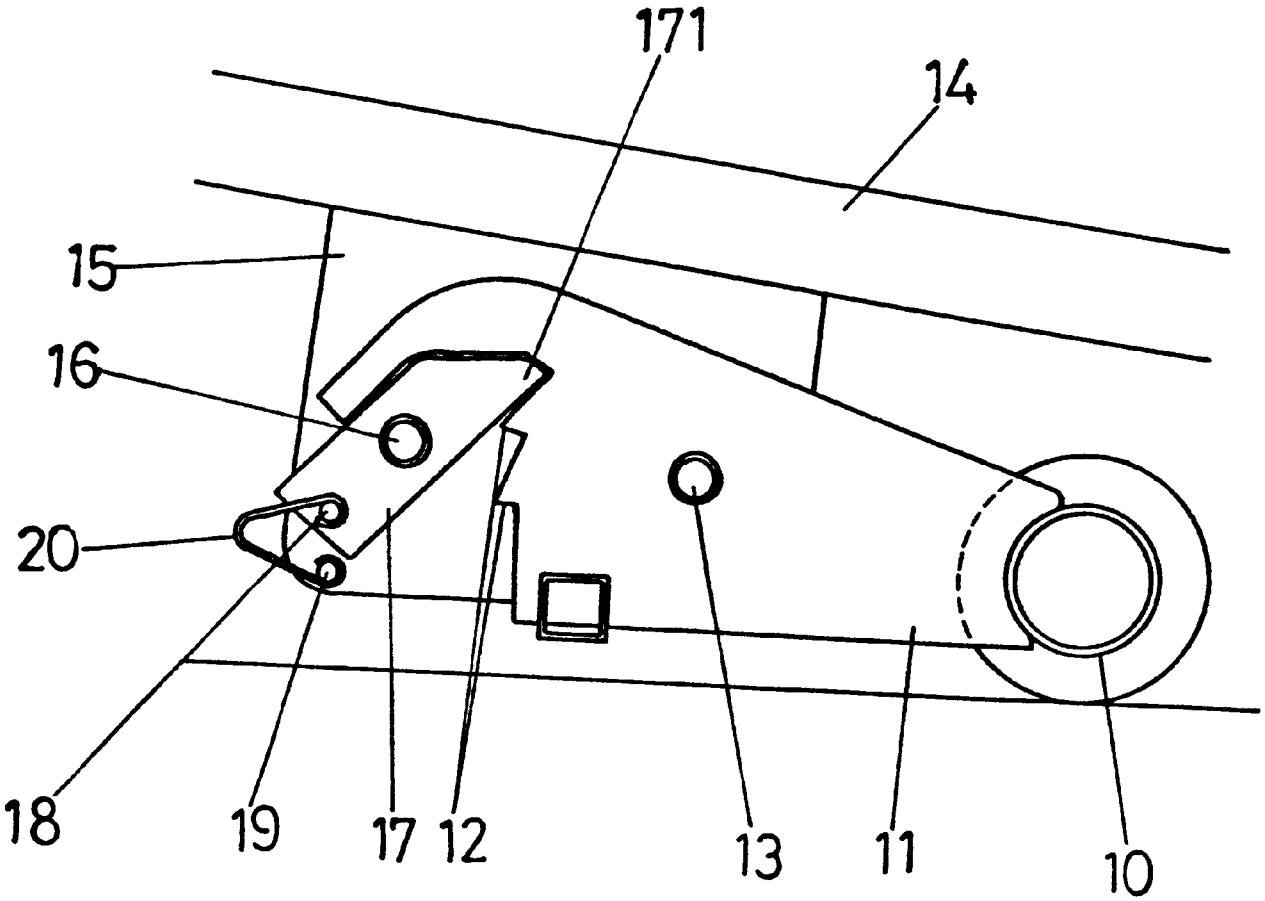
FIG.6 PRIOR ART
FIG. 6 is a schematic drawing in accordance with the prior art of U.S. Pat. No. 5,607,375.

Finally, referring to FIG. 5, the ground-contacting member 40 in accordance with the present invention is situated at two sides on the bottom of the frame 33 so that, when the ground-contacting members 40 are connected together by means of a connecting rod 38, it's only required for the user to rotate one of the ground-contacting members 40 while the other ground-contacting member 40 at the other side is synchronously rotated. Thus, the adjustment operation is finished when the desired ground-contacting adjacent side is located in position. Therefore, it's very convenient and easy to use.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. An angle adjusting device for a treadmill having a frame with a running belt thereon, a handgrip frame extending from the frame, the angle adjusting device forming at least one of front and rear supports supporting the frame on a surface and comprising:

a) a pair of locating plates extending downwardly from a bottom of the frame; and, b) a polygonal ground-contacting member having at least three ground-contacting sides, pivotally attached to each of the pair of locating plates by a pivot, a distance between the pivot and each of the ground-contacting sides being different for all of the ground-contacting sides, whereby an angle of the frame relative to the surface may be varied by pivoting the ground-contacting members to bring one of the at least three ground-contacting sides into contact with the surface.

2. The angle adjusting device of claim 1 further comprising a rod connecting the ground-contacting members such that the ground-contacting members pivot synchronously.

3. The angle adjusting device of claim 1 wherein each ground-contacting member has a triangular configuration.

4. The angle adjusting device of claim 1 wherein the ground-contacting members each have four ground-contacting sides.

5. The angle adjusting device of claim 1 wherein the angle adjusting device forms rear support.

* * * * *